United States Patent [19]

Irwin

[11] 3,934,408

[45] Jan. 27, 1976

[54] CERAMIC COMBUSTION LINER

[75] Inventor: John A. Irwin, Indianapolis, Ind.

[73] Assignee: General Motors Corporation, Detroit, Mich.

[22] Filed: Apr. 1, 1974

[21] Appl. No.: 456,601

[52] U.S. Cl. ..... 60/39.65; 60/39.66; 431/352

[51] Int. Cl.[2] ..... F23D 15/02; F02G 3/00

[58] Field of Search..... 60/39.65, 39.66, 200 A, 60/39.69; 431/352, 116, 353

[56] References Cited

UNITED STATES PATENTS

| | | | |
|---|---|---|---|
| 2,601,390 | 6/1952 | Hague | 60/39.65 X |
| 3,545,202 | 12/1970 | Batt et al. | 60/39.65 |
| 3,594,109 | 7/1971 | Penny | 60/39.65 X |

*Primary Examiner*—Carlton R. Croyle
*Assistant Examiner*—Thomas I. Ross
*Attorney, Agent, or Firm*—Paul Fitzpatrick

[57] ABSTRACT

A combustion liner for a gas turbine combustion apparatus has a wall of ceramic material. To minimize destructive thermal gradients in the ceramic material due to local cooling by air entering the liner through ports for combustion or dilution air, the walls of these ports are isolated from the entering air by metal bushings inserted through each port, these bushings being retained by a band encircling the liner and connected to the bushings.

11 Claims, 11 Drawing Figures

CERAMIC COMBUSTION LINER

My invention is directed to combustion apparatus such as is employed in gas turbine engines. Particularly, it is directed to improvements in ceramic combustion liners operative to reduce thermal gradients attendant upon the entrance of air into the liner through the usual ports.

It is well known that combustion apparatus of the sort employed in gas turbine engines ordinarily includes an outer housing or casing to which compressed air is introduced and a combustion liner into which the air flows from the housing and within which combustion takes place between the air so entering and fuel which is sprayed or otherwise diffused within the liner. In such devices, the combustion is quite intense and the heat is high; in fact, in many cases the air entering the combustion apparatus is at about 1000°F. and often it is at 2000°F. or higher at discharge from the combustion apparatus. The maximum temperature in the flame zone may be 3000°F. or higher.

Typical prior art combustion apparatuses have employed combustion liners of high temperature resistant metal alloys. These have been quite successful, but are also quite expensive.

It appears highly desirable to find a satisfactory way to substitute molded ceramic liners or portions of liners for the metal liners previously employed. High temperature resisting ceramic compositions may be formed or molded and fired to provide accurately dimensioned parts of very high temperature resisting capabilities which have some advantages other than cost over the metal structures referred to above. However, there are difficulties attendant upon the use of such ceramics, among them being the likelihood of cracking or breakage of the ceramic material due to stresses resulting from thermal gradients. such gradients cause high stresses in the ceramic material, which is brittle rather than ductile as in the case of the metal liner.

In the usual combustion liner the air for combustion is introduced through ports in the wall of the liner and dilution air is introduced through ports at the downstream end of the combustion zone of the liner to reduce the temperature of the combustion products. Obviously, with a liner in which intense combustion is taking place, the ceramic waall will be very hot. On the other hand, the combustion air entering through the ports is ordinarily at least 1000° cooler than the flame temperature. It is inconsistent with satisfactory service life of the ceramic to have the margins of the air ports cooled by the entering air to a temperature much lower than the immediately surrounding parts of the liner wall.

My present invention is based upon the concept of providing bushings or sleeves lining these ports in the liner so as largely to isolate the ceramic material from the entering air. It also involves structures of the bushings and of arrangements for retaining them in place.

The principal objects of my invention are to provide an improved gas turbine combustion apparatus of lower cost, to provide a ceramic combustion liner wall structure best adapted to meet the requirements of practice, to provide simple, reliable, and inexpensive means for protecting the ceramic liner walls from combustion or dilution air entering through ports in the wall, and to provide improved and highly suitable structures of bushing arrangements for so isolating the liner wall from the entering air.

The nature of my invention and its advantages will be apparent to those skilled in the art from the succeeding detailed description of preferred embodiments of the invention and the accompanying drawings of them.

Before proceeding with the description of the embodiments of my invention, I call attention to Penny U.S. Pat. No. 3,594,109, issued July 20, 1971, which shows a ceramic lining for a metal combustion liner or flame tube and in which bushings extending through the air holes of the liner are fixed to the metal wall.

Figure 1:
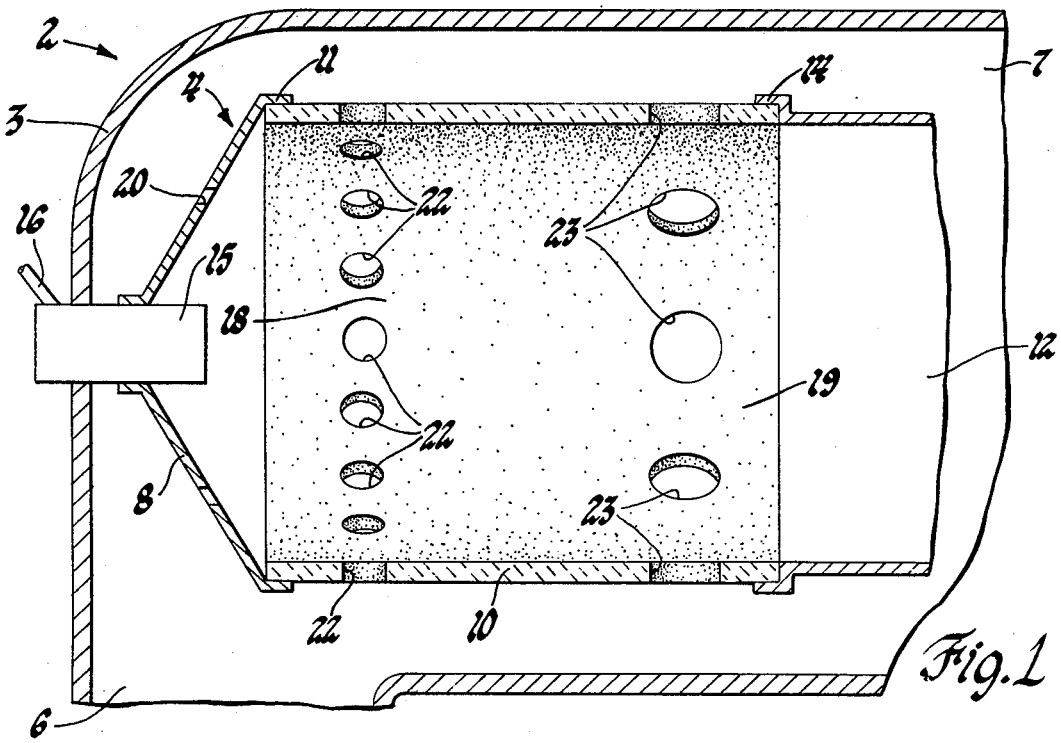
FIG. 1 is a schematic illustration of a gas turbine combustion apparatus incorporating a ceramic liner wall, taken in a plane containing the axis of the liner.

FIG. 1 shows somewhat schematically one form of general arrangement of a gas turbine combustor incorporating a ceramic liner wall. The combustion apparatus 2 includes a housing 3 enclosing a generally cylindrical space within which a combustion liner 4 is mounted. Compressed air for combustion may enter the housing through an air entrance 6. The other end of the housing may be closed by means not illustrated. Alternatively, the compressed air might enter through the downstream end 7 of the housing, and the air entrance 6 could be closed. The combustion liner 4 includes a dome or upstream end closure 8 and a side wall 10 preferably of circular cross section. The side wall is made of a suitable ceramic material; for example, silicon carbide. The side wall is inserted within a peripheral flange 11 of the dome at its upstream end and its downstream end is coupled to a duct 12 which conducts the combustion products to a turbine or other user (not illustrated). As shown, the downstream end of the liner is seated in an enlarged seat 14 at the upstream end of duct 12. The wall 10 is thus supported by dome 8 and duct 12. As illustrated, the upstream end of the liner is supported by a fuel nozzle 15 mounted in the wall of housing 3, to which fuel is supplied by a fuel line 16.

The liner defines a combustion zone indicated generally at 18 toward the upstream end of the liner 10 and a dilution zone indicated at 10 towards the downstream end of the liner. Some air for combustion may enter through the fuel nozzle. More air ordinarily enters through ports such as those indicated as 20 in the dome and, generally, the greater part of the combustion air enters through one or more rows of ports 22 distributed circumferentially around the liner. The structure of dome 8 may be similar to that illustrated in U.S. Pat. No. 3,656,298 of Wade issued Apr. 18, 1972, except that there is no air admission at the outer edge of the dome.

Dilution air, which ordinarily is of greater quantity than combustion air, may enter the liner through a circumferential row of larger ports 23 toward the downstream end of the liner. Except for the presence of a ceramic liner wall, structure of the engine and of the combustion apparatus may be similar to those described in U.S. Pat. Nos. as follows: Collman et al. 3,077,074, Feb. 12, 1963; Collman et al. 3,267,674, Aug. 23, 1966; and Bell 3,490,746, Jan. 20, 1970.

As to all the air ports 22 and 23, it will be apparent that relatively cool air flowing through the ports at fairly high velocity will tend to cool the liner wall 10 immediately in the vicinity of the ports to a temperature substantially below that of the adjoining portions of the wall. Such thermal gradients set up mechanical stresses in the material which have been found in practice to result in spalling or cracking of the liner wall which may render it unfit for service in an undesirably short time.

My invention is directed to providing simple, reliable, and inexpensive means to overcome this problem by channeling the flow into the liner through bushings, sleeves, or the like which isolate the ceramic material from direct contact with the inflowing compressed air. Various physical forms or embodiments of the invention are illustrated in FIGS. 2 through 11 of the drawings. It will be understood that any of these forms could be employed with the liner structure illustrated in FIG. 1. In these figures the liner wall 10 of FIG. 1 is illustrated fragmentarily, but sufficiently to illustrate the installation of the bushings. In all of FIGS. 2 through 11 the air hole is indicated as 24, which is intended to refer either to a primary air port 22 or a dilution air port 23.

Figure 2:
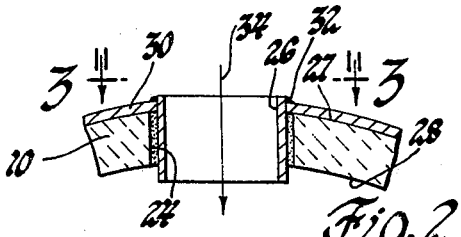
FIG. 2 is a transverse sectional view of a liner as in FIG. 1 including the first form of means for protecting the liner from entering air.
Figure 3:
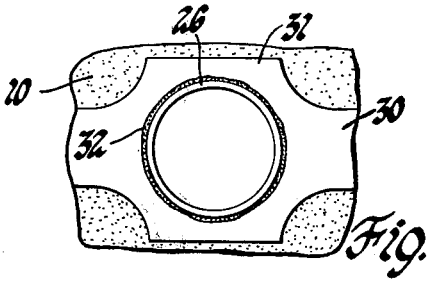
FIG. 3 is a plan view of the same, taken of the plane indicated by the line 3—3 in FIG. 2.

In the structure of FIG. 2, a cylindrical bushing 26 fitted in the hole 24 preferably projects somewhat from both the exterior surface 27 and the interior surface 28 of the liner wall 10. The clearance of the bushing from the wall is exaggerated for clarity of the figure and may be negligible. The bushing should be loose enough not to tend to break the liner by relative thermal expansion. The greatest expansion of the bushing relative to the liner would occur immediately after shutdown of the combustion apparatus, when flow of air drops off and the bushing tends to become additionally heated by radiation or conduction from the wall 10. The metal bushing expands much more greatly for a given increase of temperature than the wall 10, but in normal operation the bushing can be expected to be significantly cooler than the wall. In general, however, it may be expected to be a close fit under operating conditions and somewhat looser when the entire structure is cold. Exact clearances will depend upon the characteristics of a particular installation.

Each bushing 26 is welded or brazed to a retainer ring or strap 30 which extends entirely around the periphery of the liner. Preferably, the strap is narrower between the ports than the width of the ports but has wider portions 31 overlying each port 24. The bushings 26 preferably are fixed to the strap 30 by a circumferential weld 32 around the bushing at the outer surface of the strap 30.

For installation of the metal structure, the strap may be continuous and be slid over the liner, after which the bushings are inserted into the strap and welded in place. Alternatively, the strap may be open at one point, with the bushings welded in place and be wrapped around the liner and thereafter have the ends of the strap welded or otherwise secured together when the bushings are in place in ports 24.

In the usual installation, the strap 30 will expand more than the liner in service and therefore it may be a close fit when the parts are cold. The additional expansion operation is not significant so far as the isolation of the liner from the entering air is concerned. It will be apparent upon examination of FIGS. 2 and 3 that the air current indicated by the arrow 34 will be effectively isolated from the wall portion of the liner wall bounding the air port 24. If there is any flow outside the bushing, it will be trivial and of low velocity and low cooling effect on the ceramic.

Figure 4:
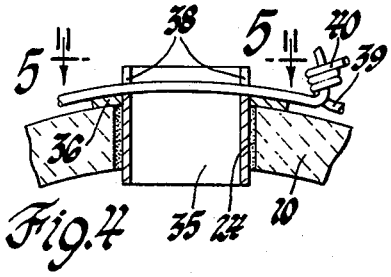
FIG. 4 is a view similar to FIG. 2 of a second form of the invention.
Figure 5:
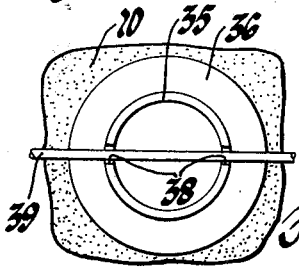
FIG. 5 is a plan view of the same, taken on the plane indicated by the line 5—5 in FIG. 4.

Referring now to FIGS. 4 and 5, each bushing 35 is welded or brazed to a preferably circular washer 36 which abuts the outer surface of the liner. Diametrically opposed slots 38 are cut in the outer end of the bushing 35. These receive a retaining ring in the form of a wire 39 which extends around the liner, the ends of which may be secured by twisting together as indicated at 40. In this case, the bushings are inserted in the openings 24 and the wire 39 is wrapped around the liner and fitted into the notches 38, ahd closed by twisting. The washer 36 keeps the bushing from falling into the inside of the liner and also may be of some benefit in closing off flow past the outer surface of the bushing.

Figure 7:
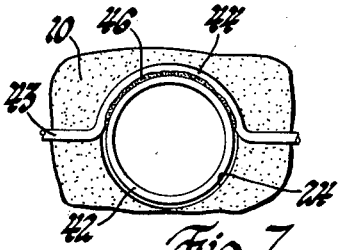
FIG. 7 is a plan view of the same, taken on the plane indicated by the line 7—7 in FIG. 6.
Figure 6:
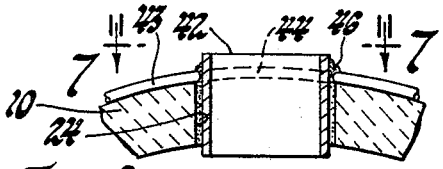
FIG. 6 is a view similar to FIG. 2 of a third form of the invention.

FIGS. 6 and 7 illustrate a third form in which the bushings 42 are in the same relation to the liner as described above. The bushings are located and held in place by a retaining ring in the form of a preformed wire 43 extending around the liner. In this case the wire is formed with an approximately semicircular offsets 44 at the location of each bushing 42. The bushing is welded to the wire as indicated at 46. In this case the assembly of wire and bushing is wrapped around the liner and the ends of the wire are secured together in a suitable manner, as by welding or twisting, for example.

Figure 9:
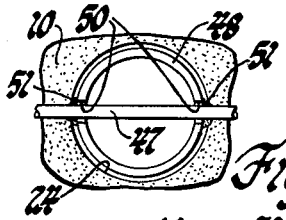
FIG. 9 is a plan view of the same, taken on the plane indicated by the line 9—9 in FIG. 8.
Figure 8:
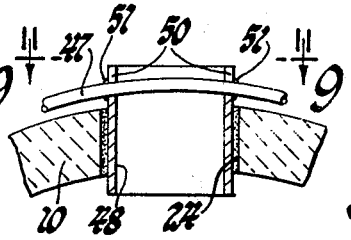
FIG. 8 is a view similar to FIG. 2 of a fourth form of the invention.

Referring to FIGS. 8 and 9, the structure shown is somewhat similar to that of FIGS. 4 and 5. However, in this case the retaining wire 47 is fixed to the bushings 48. Each bushing has two diametrically opposed slots 50 in its outer end in which the wire 47 is laid and the wire is fixed to the bushing by welds indicated at 51. This assembly may then be mounted on the liner and the ends of the wire 47 suitably joined.

Figure 11:
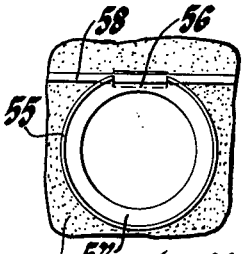
FIG. 11 is a plan view of the same, taken on the plane indicated by the line 11—11 in FIG. 10.
Figure 10:
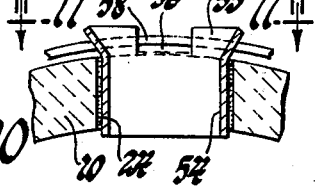
FIG. 10 is a view similar to FIG. 2 of a fifth form of the invention.

Finally, the form shown in FIGS. 10 and 11 differs from those previously described in several respects. For one thing, the bushing 54 has a flaring or funnel-shaped outer end 55 which may lodge against the outer surface of the liner 10 when the bushing is inserted. This may have desirable characteristics with respect to air flow through the bushing in certain installations. Obviously, such a funnel-shaped outer end can be employed in the structures shown in the other figures. For retention, a tab or flange 56 is bent out from the outer end portion 55. This flange engages the outer surface of the liner. Flanges 56 of bushings 54 for a particular row or circle of holes are overlaid by a preferably rectangular retaining wire or strap 58 which is welded or brazed to the outer surface of the tab. This strap may be double ended and have its ends welded together after the bushings are inserted as previously explained.

It will be noted that all of the bushings illustrated extend from outside the outer surface of the liner to inside the inner surface to isolate the ceramic material of the liner from the entering air stream. Since the assembly of bushings and retainer is individual to each row or ring such as 22 or 23 in the liner, there is no problem of relative axial expansion of the liner and any axially extending metal bushing retaining structure. The metal parts are simple and may be easily applied. They should, of course, be made of sufficiently heat resistant metal.

The suitability of these bushing arrangements to minimize heat transfer from the ceramic liner to air flowing through ports in the liner will be apparent.

The detailed description of the preferred embodiments of the invention for the purpose of explaining the principles thereof is not to be considered as limiting or restricting the invention, since many modifications may be made by the exercise of skill in the art.

I claim:

1. A combustion apparatus comprising, in combination, a combustion liner defining a space for combustion of fuel, the liner having a wall of ceramic material of approximately circular cross section defining the exterior of the liner and defining a circumferential row of ports for admission of air into the liner, the air being significantly cooler than the wall in normal operation of the combustion apparatus, and means for reducing thermal stresses in the wall due to local cooling of the wall by air entering through the ports comprising a bushing slidably received in each port and a retainer ring means encircling the exterior of the liner supported only through the said wall connected to the bushings in a said row of ports effective to retain the bushings in the ports, the width of the retaining ring being not more than a value slightly greater than the width of the bushings transversely of the retaining ring.

2. An apparatus as defined in claim 1 in which the retainer ring means is wider at the locations of the bushings than it is between the bushings and encircles the bushings.

3. A combustion apparatus comprising, in combination, a combustion liner defining a space for combustion of fuel, the liner having a wall of ceramic material of approximately circular cross section defining the exterior of the liner and defining two circumferential rows of ports for admission of air into the liner, the rows being spaced axially of the liner, the air being significantly cooler than the wall in normal operation of the combustion apparatus, and means for reducing thermal stresses in the wall due to local cooling of the wall by air entering through the ports comprising a bushing slidably received in each port and a retainer ring means for each row of ports encircling the exterior of the liner supported only through the said wall connected to the bushings in the said row of ports effective to retain the bushings in the ports, the retainer rings being independently supported and axially located by the wall.

4. A combustion apparatus comprising, in combination, a combustion liner defining a space for combustion of fuel, the liner having a wall of ceramic material of approximately circular cross section defining the exterior of the liner including a portion defining a circumferential row of ports for admission of air into the liner, the air being significantly cooler than the liner in normal operation of the combustion apparatus, and means for reducing thermal stresses in the wall portion due to local cooling of the wall portion by air entering through the ports comprising a bushing slidably received in each port, means defining a flange on each bushing engaging the outer surface of the liner to locate the bushing radially of the liner, and a retainer ring means supported by the said wall encircling the exterior of the liner and overlying the flanges of the bushings in a said row of ports effective to retain the bushings in the ports.

5. An apparatus as defined in claim 4 in which the flange is defined by a washer fixed to and encircling the bushing.

6. An apparatus as defined in claim 4 in which the flange is defined by a tab struck out from the wall of the bushing.

7. An apparatus as defined in claim 4 in which the flange is defined by a flare on the outer end of the bushing.

8. A combustion apparatus comprising, in combination, a combustion liner defining a space for combustion of fuel, the liner having a wall of ceramic material of approximately circular cross section defining the exterior of the liner including a portion defining a circumferential row of ports for admission of air into the liner, the air being significantly cooler than the liner in normal operation of the combustion apparatus, and means for reducing thermal stresses in the wall portion due to local cooling of the wall portion by air entering through the ports comprising a bushing slidably received in each port and a wire supported by the said wall encircling the exterior of the liner connected to the bushings in a said row of ports effective to retain the bushings in the ports.

9. An apparatus as defined in claim 8 in which the wire is lodged in slots in the outer ends of the bushings.

10. An apparatus as defined in claim 9 in which the wire is welded to the bushing and retains the bushing against movement into the liner.

11. An apparatus as defined in claim 8 in which the wire is formed with a loop extending partially around the circumference of the bushing and bonded to the bushing.

* * * * *

UNITED STATES PATENT AND TRADEMARK OFFICE

CERTIFICATE OF CORRECTION

PATENT NO. : 3,934,408

DATED : January 27, 1976

INVENTOR(S) : John A. Irwin

It is certified that error appears in the above-identified patent and that said Letters Patent are hereby corrected as shown below:

Column 1, line 46, "waall" should be -- wall --;

Column 2, line 11, "of" second occurrence, should be -- on --;

Column 2, line 62, numeral "10" should be -- 19 --;

Column 4, line 9, before "operation" insert -- during --;

Column 4, line 26, "ahd" should be -- and --.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*